US005213448A

United States Patent [19]

Seider et al.

[11] Patent Number: 5,213,448

[45] Date of Patent: May 25, 1993

[54] UNDERPINNING BRACKET FOR UPLIFT AND SETTLEMENT LOADING

[75] Inventors: Gary L. Seider; J. T. Odom; M. L. Holdeman, all of Centralia, Mo.

[73] Assignee: A. B. Chance Company, Centralia, Mo.

[21] Appl. No.: 989,346

[22] Filed: Dec. 11, 1992

[51] Int. Cl.[5] ..... E02D 27/48

[52] U.S. Cl. ..... 405/230; 405/229

[58] Field of Search ..... 405/216, 229, 230, 233, 405/239, 259.5

[56] References Cited

U.S. PATENT DOCUMENTS

| | | | |
|---|---|---|---|
| 2,322,855 | 6/1943 | Lenahan | 405/230 |
| 2,451,777 | 10/1948 | Salas . | |
| 3,685,301 | 8/1972 | Heacox . | |
| 3,814,655 | 6/1974 | Weill et al. . | |
| 4,673,315 | 6/1987 | Shaw et al. . | |
| 5,013,190 | 5/1991 | Green . | |
| 5,120,163 | 6/1992 | Holdeman et al. . | |
| 5,145,291 | 9/1992 | Bullivant | 405/230 |

*Primary Examiner*—David H. Corbin

*Attorney, Agent, or Firm*—Hovey, Williams, Timmons & Collins

[57] ABSTRACT

An apparatus for stabilizing the foundation of a building structure includes a support assembly fastened to the foundation and a screw anchor installed in the earth in generally upright disposition with an upper end thereof located adjacent the foundation. The upper end is secured within a sleeve of the support assembly by a bonding composition to prevent movement of the screw anchor relative to the sleeve. During assembly of the apparatus, a lower bracket of the support assembly is attached to the foundation of a building to be stabilized, and the screw anchor is installed in the earth in generally upright disposition with an upper end of a rod of the anchor located adjacent the lower bracket. The sleeve is placed over the upper end of the rod, and a bonding composition is inserted into the interior space of the sleeve between the sleeve and the rod. The sleeve is also attached to the bracket to prevent settling and uplift movement of the foundation relative to the screw anchor.

12 Claims, 2 Drawing Sheets

UNDERPINNING BRACKET FOR UPLIFT AND SETTLEMENT LOADING

BACKGROUND OF THE INVENTION

1. Field of the Invention

The present invention relates generally to systems for stabilizing the foundation of a building structure which may or has experienced settlement or movement and, more particularly, to an apparatus for stabilizing the foundation of a building against both settling and uplift forces.

2. Discussion of the Prior Art

It is known to provide a foundation underpinning bracket and jacking tool assembly for use in stabilizing the foundation of a building, wherein a support is positioned at the bottom of a foundation, a screw anchor is driven into the ground adjacent the support, a lifting force is applied to the foundation using the screw anchor as a base for the lifting force, and the support is thereafter received over the upper end of the screw anchor so that the live and dead loads of the foundation are transferred to the screw anchor. An example of such a method is illustrated in U.S. Pat. No. 5,120,163, issued Jun. 9, 1992 and U.S. Pat. No. 5,171,107, issued Dec. 15, 1992.

Prior to development of this noted method and the associated apparatus, it was conventional to drive a pile into the earth adjacent a foundation by exerting a driving force on the pile using the foundation as a base for the driving force. One problem experienced in these conventional pile supported systems and that was overcome in the '163 patent assembly, arose due to the fact that the piles were only driven into the earth until such time as the foundation began to lift as further driving force was applied to respective piles. However, the piles were subject to further subsequent penetration into the ground resulting in further settlement of the foundation.

The '163 patent method and assembly overcomes the problems in the earlier conventional systems by providing a screw anchor in place of each pile. Because the screw anchors are embedded through the use of a torque drive exerted on the screw anchors independently of the foundation, it is possible to install the anchors to a depth sufficient to support the live and dead load of the building structure without the occurrence of further settlement of either the anchors or the foundation.

Although the '163 patent assembly represents an improvement over other conventional systems in preventing settlement of the foundation of a building structure, there is a need to provide an improved method and apparatus which can also be used in areas where uplift forces are experienced, as for example by earthquake upheavals, to prevent uplift of the foundation. The problem of uplift arises during an earthquake when repeated wave-like upward and downward movement of the earth lifts the foundation from its settlement, allowing the foundation to shift laterally or to remain in an elevated position relative to the foundation's prior, final or settled position.

OBJECTS AND SUMMARY OF THE INVENTION

Thus, it is an object of the present invention to provide an apparatus which stabilizes the foundation of a building structure against both settlement and uplift.

It is a further important object of the present invention to provide a method of stabilizing the foundation of a building structure which permits the foundation to be positioned relative to one or more screw anchors, and attached thereto in a manner such that the anchor or anchors maintain the position of the foundation relative to the earth, even when uplift conditions are experienced.

Another object of the present invention is to provide an apparatus which permits a foundation or a portion thereof to be lifted onto a number of screw anchors and secured thereto such that the foundation may be supported on the anchors while also being stabilized against uplift.

In accordance with these and other objects evident from the following description of a preferred embodiment of the invention, the apparatus includes a support assembly provided with a sleeve, and a fastening means for fastening the support assembly to the foundation to prevent relative movement between the sleeve and the foundation. The elongated rod of a screw anchor includes upper and lower ends and is anchored in the earth in generally upright disposition with the upper end of the anchor rod located adjacent the foundation. The upper end of the rod is secured within the sleeve by a bonding composition in the form of material located between the rod and the sleeve to prevent movement of the rod relative to the sleeve.

A method of stabilizing the foundation of a building structure against settling and uplifting movement includes the steps of attaching the lower bracket of a support assembly to the foundation of a building to be stabilized, and positioning the rod of a screw anchor adjacent the bracket and driving the anchor into the earth with the rod thereof in generally upright disposition with an upper end of the rod located adjacent the lower bracket. A sleeve is placed over the upper end of the anchor rod, and a bonding composition is inserted into the interior space of the sleeve between the sleeve and the rod. By then attaching the sleeve to the bracket, settlement and uplift of the foundation relative to the rod is prevented.

Preferably, the method also includes the step of lifting the foundation and bracket relative to the rod prior to attaching the sleeve to the bracket so that the foundation is lifted and supported by the rod in addition to being stabilized.

By providing an apparatus and method in accordance with the present invention, numerous advantages are realized. For example, by attaching the foundation to the support assembly and the support assembly to the rod, and by anchoring the rod in the earth, the foundation is positively locked against movement relative to the rod. Thus, the foundation is stabilized against both settlement and uplift. Another advantage arises from the use of screw anchors with the method. Specifically, in addition to permitting easy installation of the system, the use of screw anchors allows the installer to apply a predetermined torque on the anchors during installation in order to insure that the anchor provides the desired holding strength, both in compression and tension.

Further, by providing a support assembly which includes a sleeve that is detachably connected thereto, and by securing the sleeve to the rod through the use of a bonding composition, it is possible to permit subsequent lifting of the foundation relative to the anchored rod, while enabling the foundation to be re-attached to the rod once lifting is complete. Also, the epoxy provides positive retention of the anchor shaft within the sleeve and does not permit relative movement therebetween in any direction; the connected parts forming a single, unitary system component.

BRIEF DESCRIPTION OF THE DRAWING FIGURES

A preferred embodiment of the invention is described in detail below with reference to the attached drawing figures, wherein.

DETAILED DESCRIPTION OF THE PREFERRED EMBODIMENT

Figure 4:
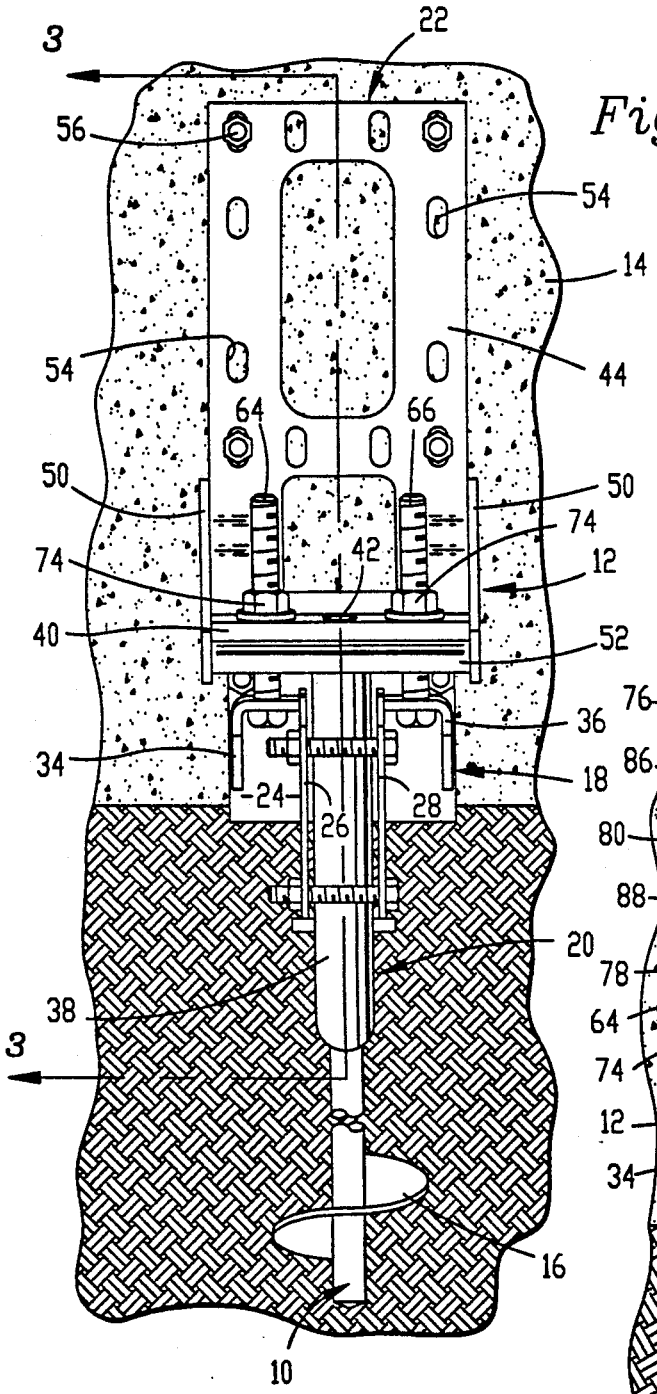
FIG. 4 is a front elevational view of the apparatus, illustrating the apparatus in an assembled condition at the bottom of the foundation of a building structure.

As best shown in FIG. 4, the present invention contemplates a method and apparatus for supporting a below-grade structural footing or lower part of a foundation forming part of an existing building structure. In general, the invention makes use of a number of anchoring apparatuses, each including an elongated screw anchor 10 as well as a foundation support assembly 12 serving to place the screw anchor, when embedded in the ground, in supporting, load-bearing relationship to the foundation 14.

In more detail, the screw anchor 10 is of conventional design and includes an elongated metallic anchor shaft which may be of square cross-sectional shape and presenting an uppermost butt end. The anchor further includes at least one transversely extending load-bearing member 16 such as a metallic helix section secured to the shaft adjacent the lower end thereof. This helix 16 functions as an anchoring means for anchoring the lower end of the shaft in the earth. Although only a single helix is illustrated in the drawings, it is understood that the screw anchor may have a number of helices along the longitudinal length of the shaft in longitudinal spaced relationship. Furthermore, one or more extension shafts having a rectangular transverse cross-sectional area may be sequentially connected to the anchor so long as each section is positively secured to the anchor to transfer both compressive and tensile loads to the anchor.

Figure 1:
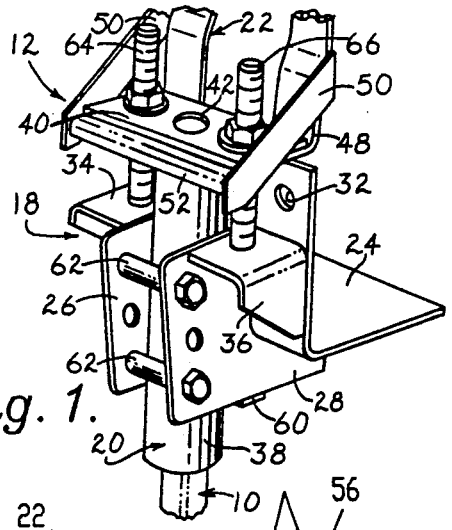
FIG. 1 is a fragmentary perspective view of a support assembly constructed in accordance with the preferred embodiment.
Figure 2:
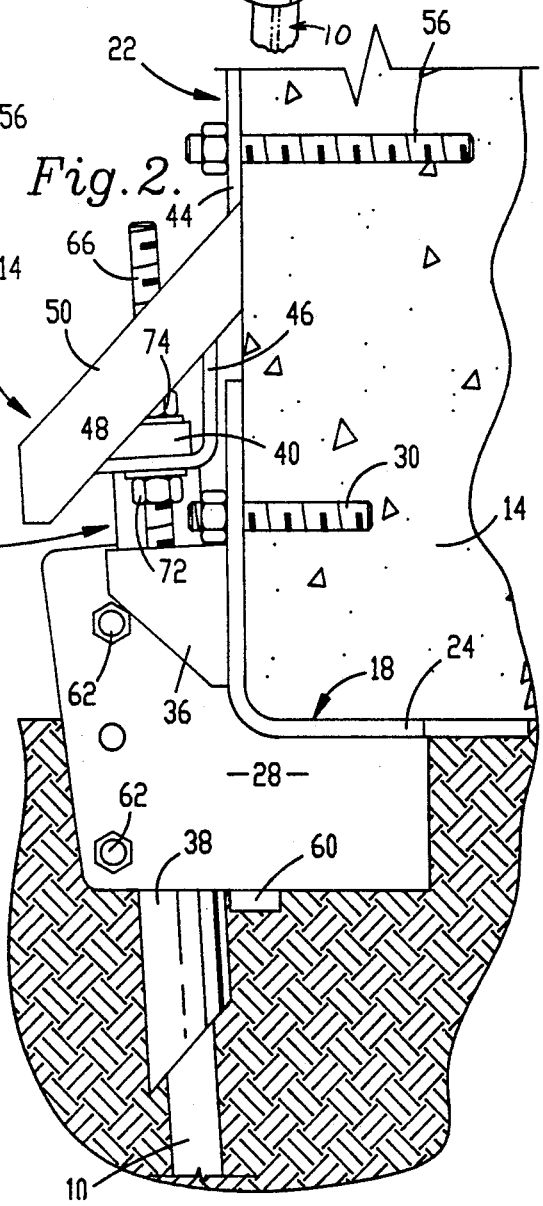
FIG. 2 is a side elevational view of an underpinning apparatus constructed in accordance with the preferred embodiment, illustrating the apparatus in an assembled condition at the bottom of the foundation of a building structure.

As best shown in FIG. 2, the foundation support assembly includes a lower bracket 18, a sleeve assembly 20, and an upper bracket 22, all preferably formed of metal. The lower bracket 18 is shown in FIG. 1, and includes an apertured, somewhat L-shaped foundation-engaging plate 24 having a pair of spaced apart, generally parallel apertured walls 26, 28 welded to the convex face thereof. The plate 24 is adapted to mate with and engage a lower external edge of the foundation 14, as shown in FIG. 2, and to be permanently attached thereto by means of anchoring bolts 30 extending through apertures 32 in the plate and into the foundation materials.

Two inverted L-shaped legs 34, 36 are welded between the upright portion of the plate 24 and the outermost faces of the walls 26, 28, at a position proximal to the upper edges of the walls. The sleeve assembly 20 is positionable between the inner faces of the walls 26, 28, and includes an elongated sleeve 38 having an open interior space extending between the ends thereof, and a top plate 40 extending across the upper end of the sleeve. The top plate, which is preferably welded to the sleeve, extends beyond the circumference of the sleeve, and includes a central aperture 42 which is substantially collinear with the interior space of the sleeve. Two other apertures are also provided in the top plate and extend parallel to but outside the sleeve.

Figure 3:
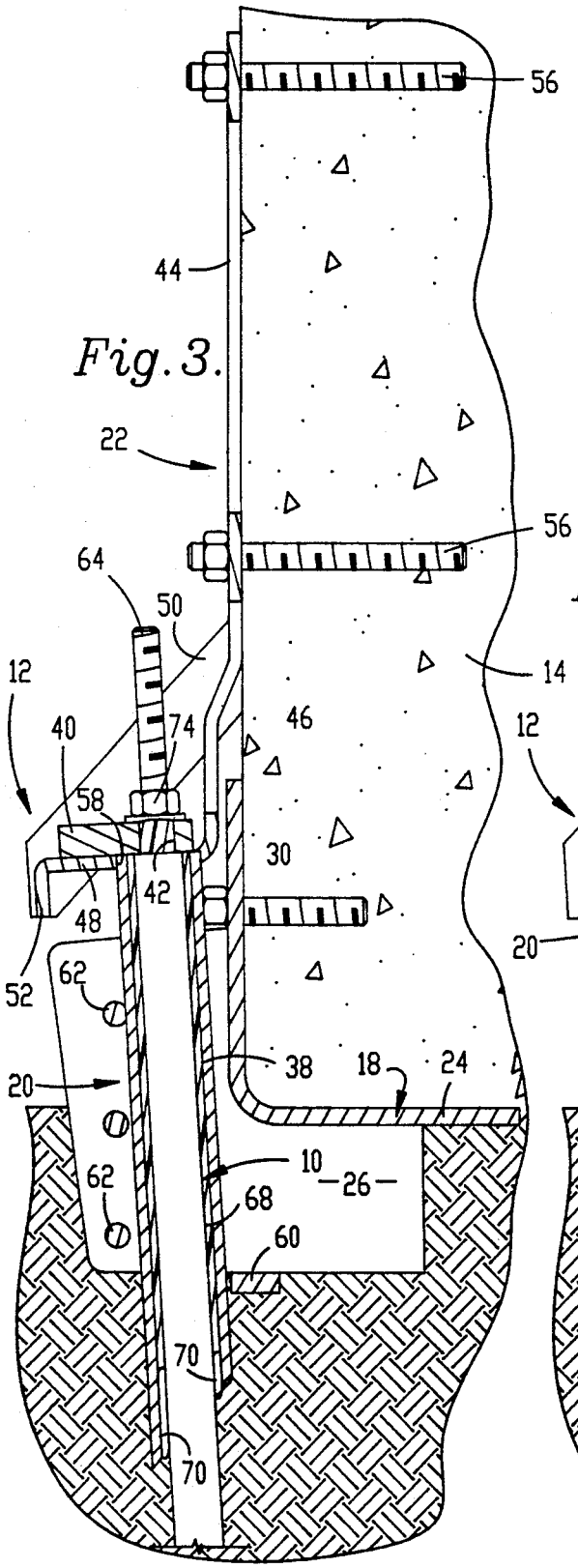
FIG. 3 is a sectional view of the assembled underpinning apparatus, as viewed along line 3—3 of FIG. 4.

The upper bracket of the support assembly, illustrated in FIG. 3, includes a generally flat mounting plate 44 adapted to be secured to the side wall of the foundation, an intermediate stepped region 46 adapted to overlap the upper edge of the lower bracket, and a seat 48 which protrudes outward from the mounting plate at an angle of about 90°, preferably 93°. As shown in FIG. 1, a pair of gussets 50 extend between the mounting plate and the distal edge of the seat for supporting the seat against bending forces exerted on the upper bracket when uplift loads are experienced by the foundation. A down-turned lip 52 extends along the edge of the seat adding further strength to the upper bracket.

As shown in FIG. 4, a plurality of holes 54 are provided in the mounting plate 44 through which anchoring bolts 56 may be inserted for fastening the upper bracket to the foundation. A number of such openings are provided in order to permit attachment of the bracket 22 to various different types of foundation materials, as well as to permit the anchoring bolts 56 to be driven into the foundation at locations where no obstacles are presented. Returning to FIG. 3, the seat 48 of the upper bracket is illustrated as including a central hole 58 which is sized to receive the sleeve 38. Additional opposed outer holes are also formed in the seat and are aligned with the opposed outer holes in the top plate of the sleeve assembly when the sleeve is fitted in the central hole 58.

The sleeve assembly 20 is adapted to be telescoped over the butt end of screw anchor 10 upon installation of the anchor assembly. A cross piece 60 is welded to the lower margins of the walls 26, 28 of the lower bracket 18, and serves as a backstop for the sleeve, while a pair of bolts 62 extending through suitable aligned openings in the walls 26, 28 retain the sleeve assembly between the walls and to prevent the lower bracket 18 from twisting relative to the screw anchor 10 about a horizontal axis extending in a direction parallel with the lower edge of the foundation.

The L-shaped legs 34, 36 of the lower bracket 18 have openings in the horizontal portions thereof which are normally aligned with the similarly sized openings in the top plate 40 and the seat 48 of the upper bracket 22 when the support assembly 12 is fully assembled. Threaded bolts 64, 66 extend upward through the respective openings in the legs 34, 36, the seat 48, and the top plate 40. As is most evident from FIG. 4, the heads of the bolts 64, 66 underlie the horizontal portions of legs 34, 36, and nuts are positioned on the bolts both beneath the seat 48 of the upper bracket 22 and above the top plate 40 to normally prevent the bolt from moving relative to the sleeve assembly and upper bracket.

In this manner, the top plate 40 is secured to the seat 48 to fix the sleeve against movement relative to the upper bracket 22, and the lower bracket 18 is normally prevented from moving downward relative to the sleeve assembly 20.

During installation of a single apparatus, the earth around the foundation 14 is excavated to a depth permitting the lower bracket 18 to be positioned below the foundation. Anchoring bolts 30 are driven through the vertical portion of the plate 24 into the foundation or wall structure to firmly affix the bracket to the adjacent outer and under surface of the building structure. The screw anchor 10 is then driven into the ground by applying torque to the anchor shaft in a direction which causes the helix to screw into the earth. During installation, the shaft is located between the walls 26, 28 of the lower bracket 18 such that the walls act as vertical guides for the screw anchor. In addition, as best shown in FIG. 3, the anchor 10 is preferably driven into the earth below the foundation 14 at an angle such that the helix 16 underlies the foundation.

After the anchor 10 has been driven to a depth such that it has a predetermined holding power, the shaft of the screw anchor is cut off so that the butt end extends to a height slightly above the upper edges of the walls 26, 28 of the lower bracket 18. The holding power in this respect of such anchor should exceed the anticipated dead weight and live load of that part of the building structure supported by the anchor assembly upon final installation thereof.

If necessary, during installation of the screw anchor 10, extensions may be added to the upper end of the shaft as required to permit driving of such anchor into the ground to a depth such that a predetermined holding power is realized. Where such extensions are used, each extension is securely fastened to the anchor shaft so that any tension exerted on the extensions is transmitted to the helix without the extensions pulling away from the anchor shaft. Preferably, each extension is fastened to the anchor shaft or to another extension through the use of a coupler extending between and fastened to both elements.

The sleeve 38 is received through the center hole 58 in the seat of the upper bracket 22 and is telescoped over the butt end of the shaft of the screw anchor 10. While the sleeve assembly 20 is positioned over the upper end of the shaft, the assembly is lifted slightly off of the anchor shaft, and a bonding composition material 68 is poured through the central aperture 42 into the interior space of the sleeve surrounding the anchor shaft. In order to prevent the bonding composition material from escaping out the bottom end of the sleeve, a filler material 70 such as clay or the like is stuffed into the bottom end of the sleeve around the shaft before the bonding composition is introduced into the sleeve.

The bonding composition includes a polymeric material, a surfactant, a curing agent, at least one filler material, and one or more additional additives for adding toughness and flexibility to the composition and for lowering the viscosity of the composition and reducing surface tension of the liquids therein to permit air bubbles within the mixture to pop during preparation.

A thermoset polymeric material, such as an epoxy material is preferably used in the composition. A possible epoxy polymeric material includes diglicidyl ether of bisphenol A resin, e.g. the epoxy resin marketed under the name EPON 828, while a possible substitute would be cycloaliphatic epoxy resins such as those marketed under the name CIBA CY184 or CY183. Where the EPON 828 material is used, an exemplary composition includes 100 parts by weight thereof.

The preferred additive for increasing the toughness and flexibility of the formula is marketed under the name JEFFAMINE D-400, used in an amount of 25 parts by weight in the exemplary composition, and the preferred curing agent is known as SHELL U, used in an amount of 12.5 parts by weight. A particular surfactant that may be used to reduce the viscosity of the composition is sold under the name BYK MALENCROT BYK 995, and is used in an amount of 1.1 parts by weight, and a material marketed as BYK MALENCROT BYK 070, in an amount of 1.0 parts by weight, is used to reduce surface tension of liquids in compositions.

The filler material preferably includes a mixture of sand and glass beads. The sand may be any conventional type of silica or silicon dioxide, crystalline silica, or quartz, the preferred material being a silica sand marketed as WEDRON 4060 having a particle size between U.S. Sieve No. 20 and 140. One type of glass beads preferred for use in the composition is No. 3000 glass beads or spheres, having a size less than U.S. Sieve No. 325 and a specific gravity of approximately 2.48. The preferred ratio of sand to glass beads in the exemplary composition is 60:40 by weight, with 200 parts sand and 133.3 parts glass beads.

The exact ratio of the filler mixture may vary, and is preferably determined through the use of packing fraction testing which enables identification of that point for each tested mixture at which all discontinuous phase surfaces of the tested filler mixture are wet by the polymeric material and all spaces between the filler material are filled by the polymeric material in a tightly packed mass. By conducting such testing on various filler mixture ratios, it is possible to determine the preferred ratio at which a minimum amount of polymeric material is required to reach the packing fraction.

After the interior space has been filled with bonding composition, the sleeve assembly 20 is pressed back down onto the top of the butt end of the shaft so that compressive loads experienced by the sleeve assembly will be transmitted directly to the shaft after the bonding composition has set.

While the bonding composition is still pliable, the pair of bolts 62 are fastened between the walls 26, 28 to retain the sleeve assembly 20 between the walls. The bolts 64, 66 are then inserted upward through the holes in the legs 34, 36, fitted with nuts 72, inserted through holes in the seat 48 and top plate 40, and fitted with nuts 74.

Where it is desired to simply stabilize the foundation against uplift and settlement, without first lifting the load of the foundation onto the screw anchor, the upper bracket 22 is attached to the foundation 14 above both the sleeve assembly 20 and lower bracket 18 through the use of the anchoring bolts 56. Thereafter, the nuts 74 are tightened down against the top plate 40 and the nuts 72 are tightened up against the lower side of the seat 48 in order to fix the position of the bolts relative to the top plate of the sleeve assembly and to limit downward movement of the upper and lower brackets, and thus the foundation, relative to the screw anchor.

In addition, because the upper bracket 22 is attached to the foundation above the sleeve assembly 20, and the seat 48 of the upper bracket is securely retained against the underside of the top plate 40, the upper bracket experiences tension when an uplift force is exerted on the foundation. Thus, uplift of the foundation relative to the screw anchor is resisted.

Figure 5:
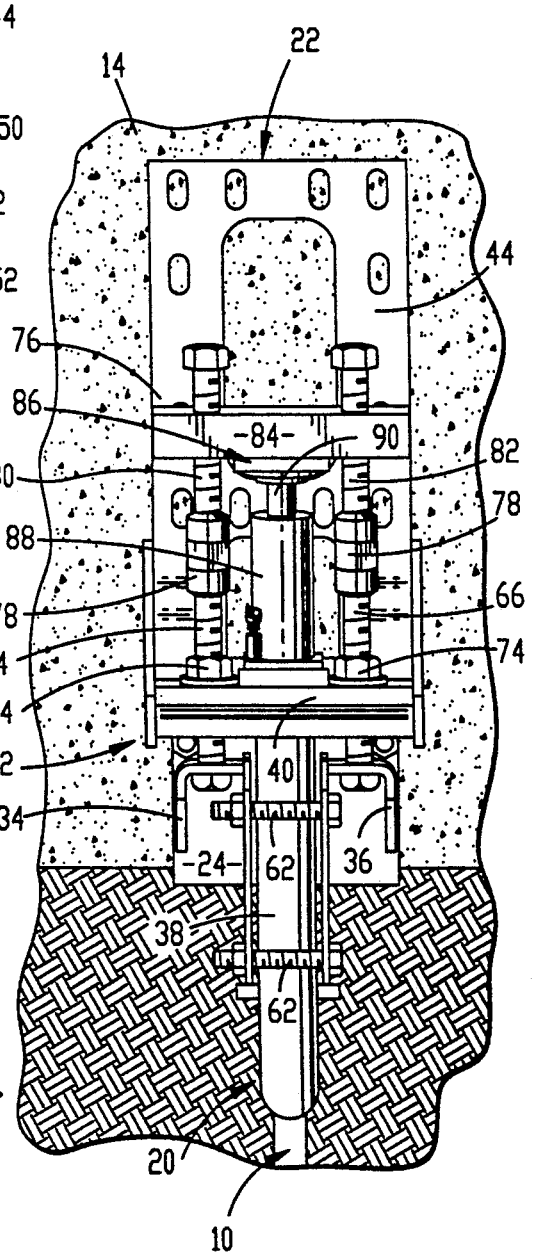
FIG. 5 is a front elevational view of the apparatus, illustrating a jacking assembly used during assembly of the apparatus to lift the foundation relative to the screw anchor.

If it is desired to lift the foundation relative to the screw anchor before stabilizing the structure, additional steps are required. Initially, after the bolts 64, 66 have been inserted through the legs 34, 36, seat 48 and top plate 40, and the nuts 74 tightened down against the top plate 40, the nuts 72 are loosened and a jacking assembly 76, as shown in FIG. 5, is positioned on the top plate. Special jacking nuts 78 are threaded onto the upper ends of the bolts 64, 66, while the lower ends of two jacking bolts 80, 82 are threaded into the upper ends of the jacking nuts 78.

A cross plate 84 extends between the jacking bolts, and includes a pair of threaded holes through which the jacking bolts extend. A jack 86 rests atop the top plate, and includes a pneumatic or hydraulic cylinder 88 and piston 90 that slides relative to the cylinder and bears against the cross plate 84.

Once this arrangement is assembled, pneumatic or hydraulic fluid is directed to the cylinder causing extension of the piston 90. This motion raises the cross plate 84 and the jacking bolts 80, 82, and is transmitted through the bolts 64, 66 to the lower bracket 18 and thus the foundation such that the foundation is lifted relative to the screw anchor 10.

After the foundation has been lifted to a desired height, the nuts 74 are tightened down onto the top plate 40, and the nuts 72 are tightened up against the underside of the seat 48. The lifting pressure is then relieved from the cylinder 88, the jacking nuts 78 are removed from the bolts 64, 66, and the jacking assembly 76 is lifted from the apparatus. The upper bracket 22 remains unattached to the foundation during lifting, but is secured to the foundation once lifting is complete.

One feature of the inventive method is the fact that if it is desired at a later time to again lift the foundation relative to the screw anchor this can be readily accomplished by re-excavating the area around the support apparatus, and repeating the procedure described above followed by retightening of the nuts 72, 74. However, it is necessary to remove the anchoring bolts 56 from the upper bracket 22 before additional lifting of the foundation relative to the screw anchor is carried out. Once lifting is complete, the upper bracket is reattached to the foundation to transmit uplift forces exerted on the foundation to the screw anchor.

According to an alternate method, it is possible to dispense with the upper bracket, and to connect the sleeve assembly to the lower bracket in such a way as to transmit both download and uplift forces to the screw anchor. Specifically, by providing an additional pair of nuts on each of the bolts 64, 66 between the legs 34, 36 and the top plate 40, a positive connection between the sleeve assembly and the lower bracket is obtained. By securing nuts against both the upper and lower surfaces of the top plate 40, and against the upper surface of the legs 34, 36, no relative movement is permitted between the lower bracket 18 and the screw anchor 10.

Although this alternate method is able to protect against some uplifting of the foundation, it places the bolts 64, 66 in compression during uplift, and places large loads on the anchoring bolts 30. Thus, the illustrated system and method is preferred.

It is noted that the present invention permits an existing system, such as one constructed in accordance with either of the previously discussed U.S. Pat. Nos. 5,120,163 and 5,171,107, to be retrofitted with an uplift support system in accordance with the present invention. This is achieved by securing the screw anchor to the sleeve assembly, as discussed above, and securing the sleeve assembly to the foundation through one or more brackets.

Although the invention has been described with reference to the preferred embodiment illustrated in the attached drawing figures, it is understood that substitutions may be made and equivalents employed herein without departing from the scope of the invention as recited in the claims.

What is claimed is:

1. An apparatus for stabilizing the foundation of a building structure, comprising:

a support assembly including a sleeve;

a fastening means for fastening the support assembly to the foundation to prevent relative movement between the sleeve and the foundation;

an elongated screw anchor including a rod having upper and lower ends, and a load bearing element connected to the rod adjacent the lower end, wherein the upper end of the rod is sized for receipt in the sleeve of the support assembly and the load bearing element is adapted to anchor the lower end of the rod in the earth with the rod disposed in generally upright disposition with the upper end of the rod located adjacent the foundation; and a securing means for securing the upper end of the rod within the sleeve to prevent movement of the rod relative to the sleeve, the securing means including a bonding composition inserted between the rod and the sleeve.

2. An apparatus as recited in claim wherein the support assembly includes a bracket adapted to be located at a position along the length of the foundation, the fastening means including a connecting means for detachably connecting the sleeve to the bracket to prevent relative movement between the sleeve and the bracket, and a fastener for securing the bracket to the foundation.

3. An apparatus as recited in claim 2, further comprising lifting means for lifting the foundation and bracket relative to the sleeve and screw anchor while maintaining the rod in supporting relationship to the foundation.

4. An apparatus as recited in claim 3, wherein the lifting means includes a jack, a means for positioning the jack on the sleeve, and a means connected to the jack for engaging the bracket to enable the jack to lift the bracket and foundation relative to the screw anchor.

5. An apparatus as recited in claim 2, wherein the support assembly further includes an upper bracket, a means for connecting the sleeve to the upper bracket and a means for fastening the upper bracket to the foundation above the sleeve so that uplift forces exerted on the foundation are transmitted to the screw anchor through the upper bracket, the sleeve, and the bonding composition.

6. An apparatus as recited in claim wherein the sleeve includes an interior space, upper and lower ends, and a top plate closing off the upper end, the top plate including a hole communicating with the interior space to permit the bonding composition to be introduced into the interior space during assembly of the apparatus.

7. An apparatus as recited in claim 1, wherein the bonding composition includes an epoxy mixed with a filler including an aggregate that adds shear strength to the bonding composition.

8. An apparatus as recited in claim 7, wherein the aggregate is selected from the group including sand and glass beads and a combination thereof.

9. A method of stabilizing the foundation of a building structure against settling and uplifting movement, the method comprising the steps of:

attaching the bracket of a support assembly to the foundation of a building to be stabilized;

positioning a screw anchor adjacent the bracket and imparting a rotational torque to the screw anchor to install the screw anchor in the earth in generally upright disposition with an upper end of the screw anchor located adjacent the lower bracket;

placing a sleeve over the upper end of the screw anchor, the sleeve including an interior space within which the upper end of the rod is received;

inserting a bonding composition into the interior space of the sleeve between the sleeve and the screw anchor;

attaching the sleeve to the bracket to prevent settling and uplift movement of the foundation relative to the screw anchor.

10. A method as recited in claim 9, further comprising the step of lifting the foundation and bracket relative to the screw anchor prior to attaching the sleeve to the bracket so that the foundation is lifted and supported by the screw anchor in addition to being stabilized against settling and uplift movement.

11. A method as recited in claim 9, further comprising the step of attaching the sleeve to an additional upper bracket of the support assembly, and fastening the upper bracket to the foundation above the sleeve so that uplift forces exerted on the foundation are transmitted to the screw anchor through the upper bracket, the sleeve, and the bonding composition.

12. A method as recited in claim 10, wherein the step of inserting a bonding composition into the interior space of the sleeve includes inserting a mixture including an epoxy mixed with an aggregate that adds shear strength to the bonding composition.

* * * * *